US007887675B2

(12) United States Patent
Norrman et al.

(10) Patent No.: US 7,887,675 B2
(45) Date of Patent: Feb. 15, 2011

(54) PRESS, METHOD IN A PRESS AND PRESS ELEMENT FOR A PRESS

(75) Inventors: Joakim Norrman, Karlstad (SE); Tord Gustavsson, Forshaga (SE)

(73) Assignee: Metso Paper, Inc., Helsinki (FI)

( * ) Notice: Subject to any disclaimer, the term of this patent is extended or adjusted under 35 U.S.C. 154(b) by 505 days.

(21) Appl. No.: 11/569,153

(22) PCT Filed: May 20, 2005

(86) PCT No.: PCT/SE2005/000737

§ 371 (c)(1),
(2), (4) Date: Oct. 15, 2007

(87) PCT Pub. No.: WO2005/116333

PCT Pub. Date: Dec. 8, 2005

(65) Prior Publication Data

US 2008/0283208 A1 Nov. 20, 2008

(30) Foreign Application Priority Data

May 26, 2004 (SE) ..... 0401351

(51) Int. Cl.
*D21F 3/00* (2006.01)

(52) U.S. Cl. ..... 162/358.3; 162/361; 162/202

(58) Field of Classification Search ..... 162/358.3, 162/358.1, 361, 202
See application file for complete search history.

(56) References Cited

U.S. PATENT DOCUMENTS 3,783,097 A 1/1974 Justus
4,917,767 A * 4/1990 Ilmarinen et al. ..... 162/358.3
4,917,768 A * 4/1990 Ilmarinen ..... 162/358.3
5,645,691 A * 7/1997 Zuefle et al. ..... 162/358.3
5,997,695 A * 12/1999 Ilmarinen ..... 162/358.3

(Continued)

FOREIGN PATENT DOCUMENTS

DE 196 17 801 11/1997

(Continued)

OTHER PUBLICATIONS

International Search Report for International Applicatin No. PCT/SE2005/000737 completed Jul. 22, 2005.

(Continued)

*Primary Examiner*—Mark Halpern
(74) *Attorney, Agent, or Firm*—Alston & Bird LLP

(57) ABSTRACT

Press for a fiber web supported by a clothing, said press having first and second press elements that interact with each other in order to form an extended nip in a press zone for the clothing-supported fiber web, said first press element having: —a support; —a press body, being supported by the support; —an endless, flexible belt, sliding over and forming a closed loop around the press body; and —a support element, being placed inside the loop for supporting the belt, said clothing surrounding together with the belt between a first position and a second position along the loop, wherein at least the first position is located outside the press zone. According to the invention, the support element is located in the first position. The invention also relates to a method in, and a press element for such a press.

15 Claims, 8 Drawing Sheets

U.S. PATENT DOCUMENTS

| | | | | |
|---|---|---|---|---|
| 6,554,964 | B2 | 4/2003 | Brox | |
| 7,172,680 | B2 * | 2/2007 | Turunen et al. | 162/358.3 |
| 2004/0079508 | A1 * | 4/2004 | Turunen et al. | 162/358.3 |

FOREIGN PATENT DOCUMENTS

| | | |
|---|---|---|
| WO | WO 00/70143 | 11/2000 |

OTHER PUBLICATIONS

Written Opinion of the International Searching Authority for corresponding International Application No. PCT/SE2005/000737.

* cited by examiner

PRESS, METHOD IN A PRESS AND PRESS ELEMENT FOR A PRESS

The present invention relates to a press for a fibre web supported by a clothing, said press comprising first and second press elements that interact with each other defining a press zone in which the press elements (2, 3) form an extended nip for the clothing-supported fibre web, said first press element comprising:

a support;

a press body, being supported by the support;

an endless, flexible belt, being arranged for sliding over and forming a closed loop around the press body; and a first support element, being arranged inside said loop for supporting the belt, said clothing being arranged for running together with the belt between a first position and a second position along the belt loop, wherein at least the first position is located outside the press zone.

The present invention also relates to a method for stabilizing the web run in such a press.

Furthermore, the present invention relates to a press element for a press of the above-mentioned type.

In paper or paperboard production, it is common knowledge that a clothing moving between two points of support, for example a felt moving between two guide rolls, starts to vibrate naturally at certain machine speeds, wherein the clothing vibrates transversely with a natural vibration frequency specific for the actual machine speed.

In presses of the above-mentioned type, where the clothing runs together with the belt before and/or after the press zone, it poses a problem that the natural vibrations of the belt and the clothing, at certain specific machine speeds, can interact and amplify each other so that an amplitude of vibration which is detrimental to the press is created.

U.S. Pat. No. 5,645,691 describes a press having an extended nip, where the press blanket of the press and the belt of the press run in conjunction upstream the press zone of the press. A support rail, extending along the entire width of the press, is positioned upstream the press zone in order to control and compensate for the deflection of the belt across the press. Accordingly, the support rail according to U.S. Pat. No. 5,645,691 provides a certain support for the belt in a position where the belt runs in conjunction with the press blanket. Despite this, the support rail does not solve the problem with interacting natural vibrations, since the press blanket and the belt are allowed to vibrate freely when they are running in conjunction upstream the support rail.

Accordingly, one object of the present invention is to achieve a press of the above-mentioned type which is cabable of operating without any detrimental, interacting natural vibrations of the above-mentioned type arising.

Another object of the present invention is to achieve a stable web run in a press of the above-mentioned type.

The press according to the invention is characterized in that said first support element is arranged for supporting the belt in said first position.

The method according to the invention is characterized in that said first support element is located at said first position.

In the following, the invention will be described in greater detail with reference to the figures.

Figure 1:
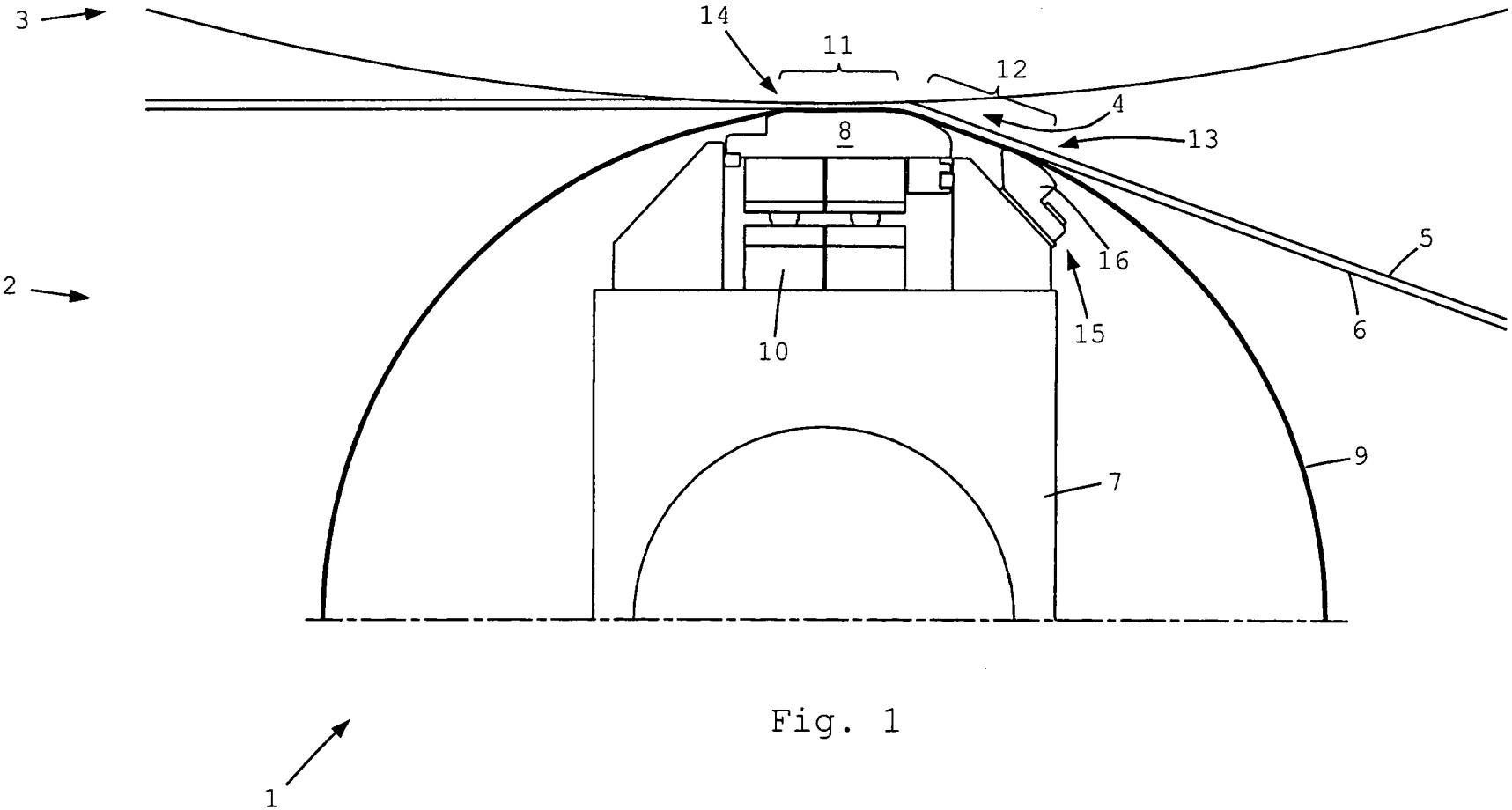
FIG. 1 shows a cross-section through a press according to the invention.
Figure 2:
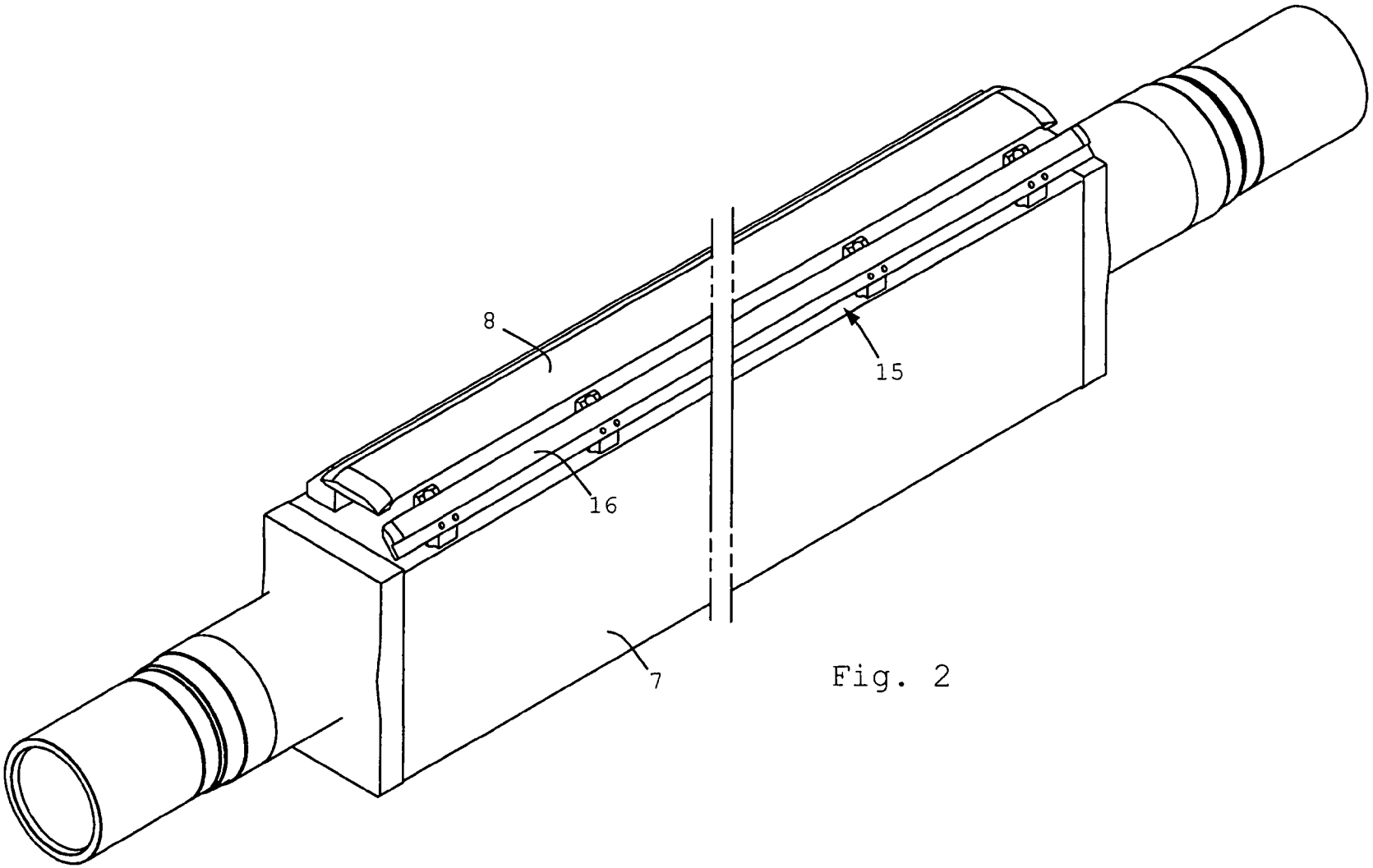
FIG. 2 shows a lateral view of a first press element of the press according to FIG. 1.
Figure 3:
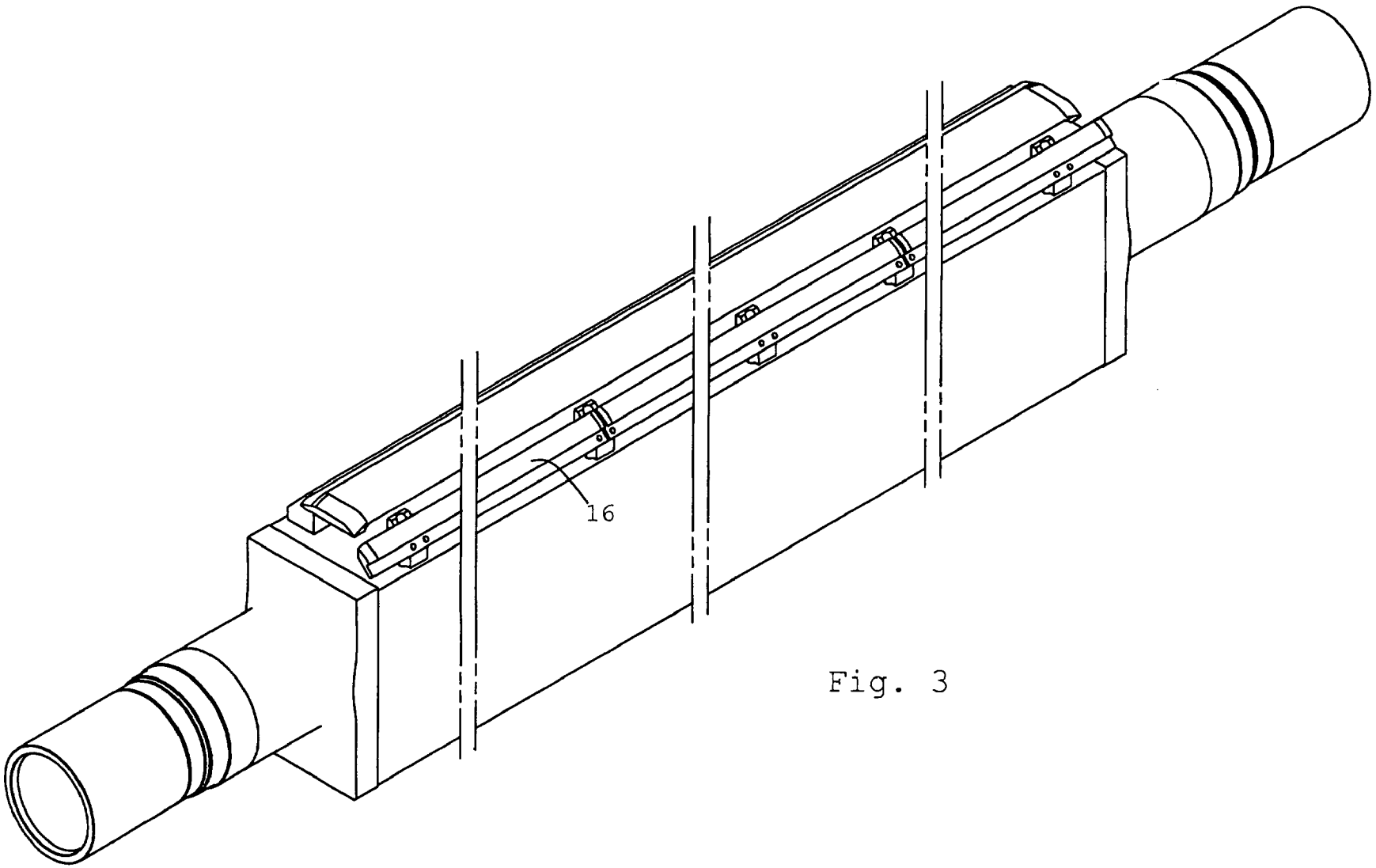
FIG. 3 shows a lateral view of an alternative embodiment of a support rail of the press according to FIG. 1.

FIGS. 1-3 show a first embodiment of a press 1 according to the invention. The press 1 comprises a first press element 2 and a second press element 3. The press elements 2 and 3 are arranged for interacting with each other in order to form an extended nip 4 therebetween. A fibre web 5 of paper or paperboard runs through the nip 4, said fibre web 5 being carried or supported by a clothing 6 in the form of a press felt. The first press element 2 comprises an internal, axial metal support 7, a press body 8, being supported by the support 7, and an endless and flexible belt 9, being attached to rotary end members (not shown) of the press element 2 in order to slide over the press body 8 and through the nip 4, in a known fashion, together with the fibre web 5 and the press felt 6. Accordingly, the belt 9 forms a closed loop around the support 7 and the press body 8. In a known fashion, the press body 8 and the belt 9 extend across the entire width of the fibre web 5. By means of hydraulic cylinders 10, the press body 8 is vertically adjustable in relation to the support 7 in order to form a press zone 11, in a known fashion, against the second press element 3, in the present case having the shape of a smooth press cylinder. For the sake of clarity, the belt 9 has been removed in FIG. 2.

Besides through the press zone 11, the fibre web 5, the press felt 6 and the belt 9 run in conjunction for a predetermined distance 12 upstream the press zone 11. Accordingly, the press felt 6 runs in conjunction with and surrounds the belt 9 all the way between a first position 13, constituting the starting point of the distance 12 and, accordingly, being located outside the press zone 11, and a second position 14, constituting the terminal point of the press zone 11. In other words, upstream the press zone, the belt 9 loop exhibits a press felt-surrounded portion coinciding with the distance 12. According to the invention, the first press element 2 comprises a support element 15, being arranged in the first position 13 for supporting the belt 9. Thereby, an efficient elimination of the transversal vibrations of the press felt 6 and the belt 9 within the distance 12 is obtained and, consequently, interacting natural vibrations are avoided. The support element 15 should be arranged within a distance extending between 5° downstream and 25° upstream the first position 13, measured along the belt 9 loop, in order to obtain a sufficient damping. Preferably, however, the support element 15 is arranged closer than that to the first position 13, for example within 3° downstream and 15° upstream the first position 13, or within 1° downstream and 5° upstream the first position 13. Most preferably, the support element 15 is arranged in the vicinity of or in close vicinity of the first position 13, so that the press felt 6 joins the belt 9 on top of or directly downstream the support element 15.

As is evident from FIG. 2, the support element 15 has the shape of a metal support rail 16 extending across the entire width of the first press element 2. As an alternative, the support rail 16 can be made of plastic, ceramics, or another material, or a combination of different materials, offering a favourable sliding surface for the belt. Preferably, the support rail 16 has a cross-section where both its upstream edge and its downstream edge exhibit a soft, bevelled shape, as shown in FIG. 1. The support rail 16 can be designed as a continuous part, as shown in FIG. 2, or be divided into a plurality of segments, together extending across the entire width of the first press element 2, as shown in FIG. 3. The support rail can also be arranged for supporting the belt only in certain discrete positions along the width of the belt (not shown).

Figure 4:
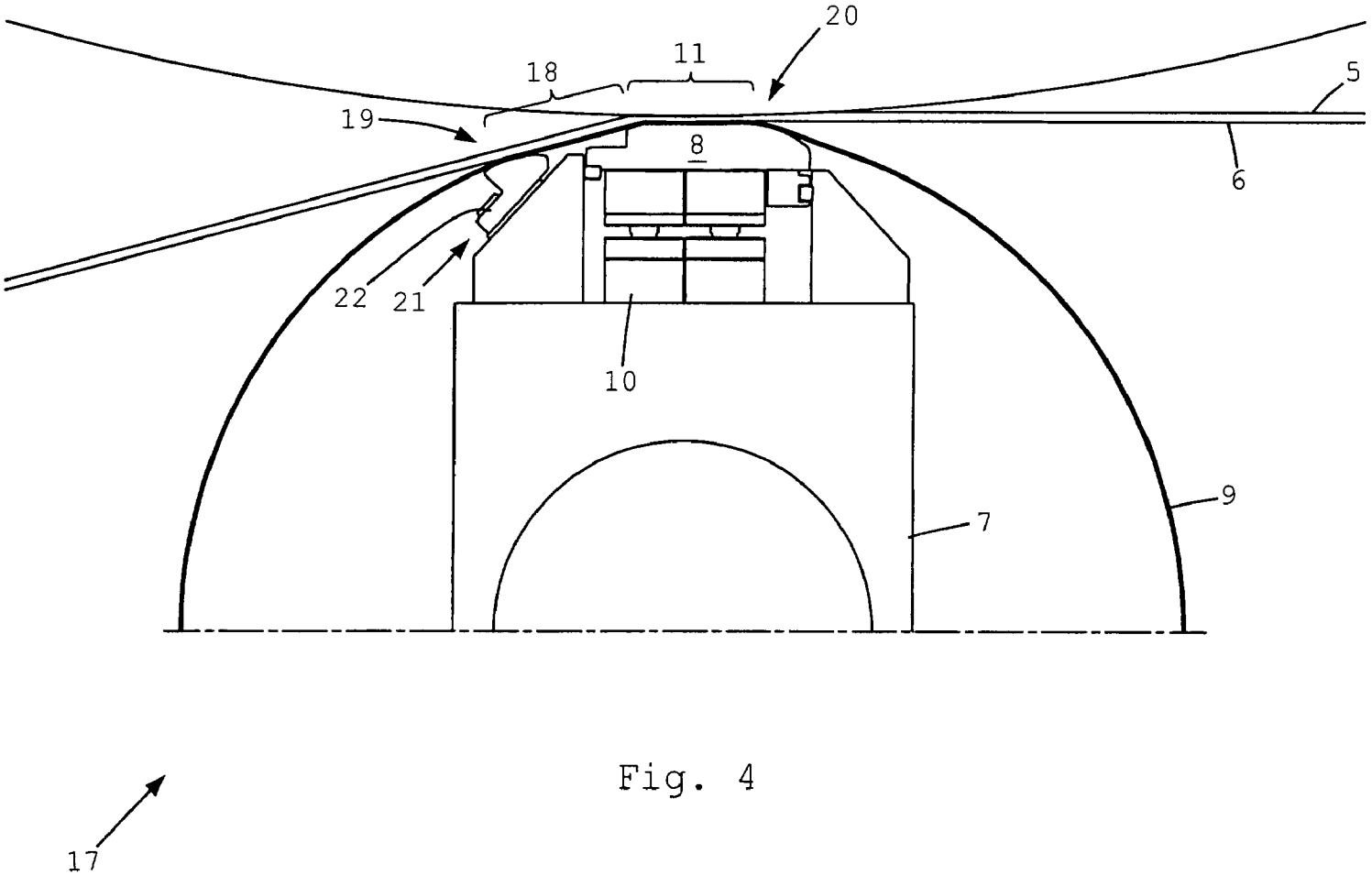
FIG. 4 shows a cross-section through a second embodiment of a press according to the invention.

FIG. 4 shows a second embodiment of a press 17 according to the invention. The press 17 is similar to the previously described press 1, with the distinction that the fibre web 5, the press felt 6 and the belt 9 in this case run together for a predetermined distance 18 downstream the press zone 11. Accordingly, the press felt 6 runs in conjunction with and surrounds the belt 9 between a first position 19, constituting the terminal point of the distance 18 and which, accordingly, is located outside the press zone 11, and a second position 20, constituting the starting point of the press zone 11. In other words, in this case the belt 9 loop exhibits a press felt-surrounded portion downstream the press zone 11, said portion coinciding with the distance 18. In the first position 19 and inside the belt 9 loop, a support element 21 is arranged for supporting the belt 9. The support element 21 should be arranged within a distance extending between 5° upstream and 25° downstream the first position 19, measured along the belt 9 loop, in order to obtain a sufficient damping. Preferably, however, the support element 21 is arranged closer than that to the first position 19, for example within 3° upstream and 15° downstream the first position 19, or within 0° upstream and 5° downstream the first position 19. Most preferably, the support element 21 is arranged in the vicinity of or in close vicinity of the first position 19, so that the press felt 6 deviates from the belt 9 on top of or directly upstream the support element 21. Also in this case, the support element 21 has the shape of a support rail 22, extending across the entire width of the first press element and which can be designed as a continuous part or be divided into several segments, together extending across the entire width of the press element.

Figure 5:
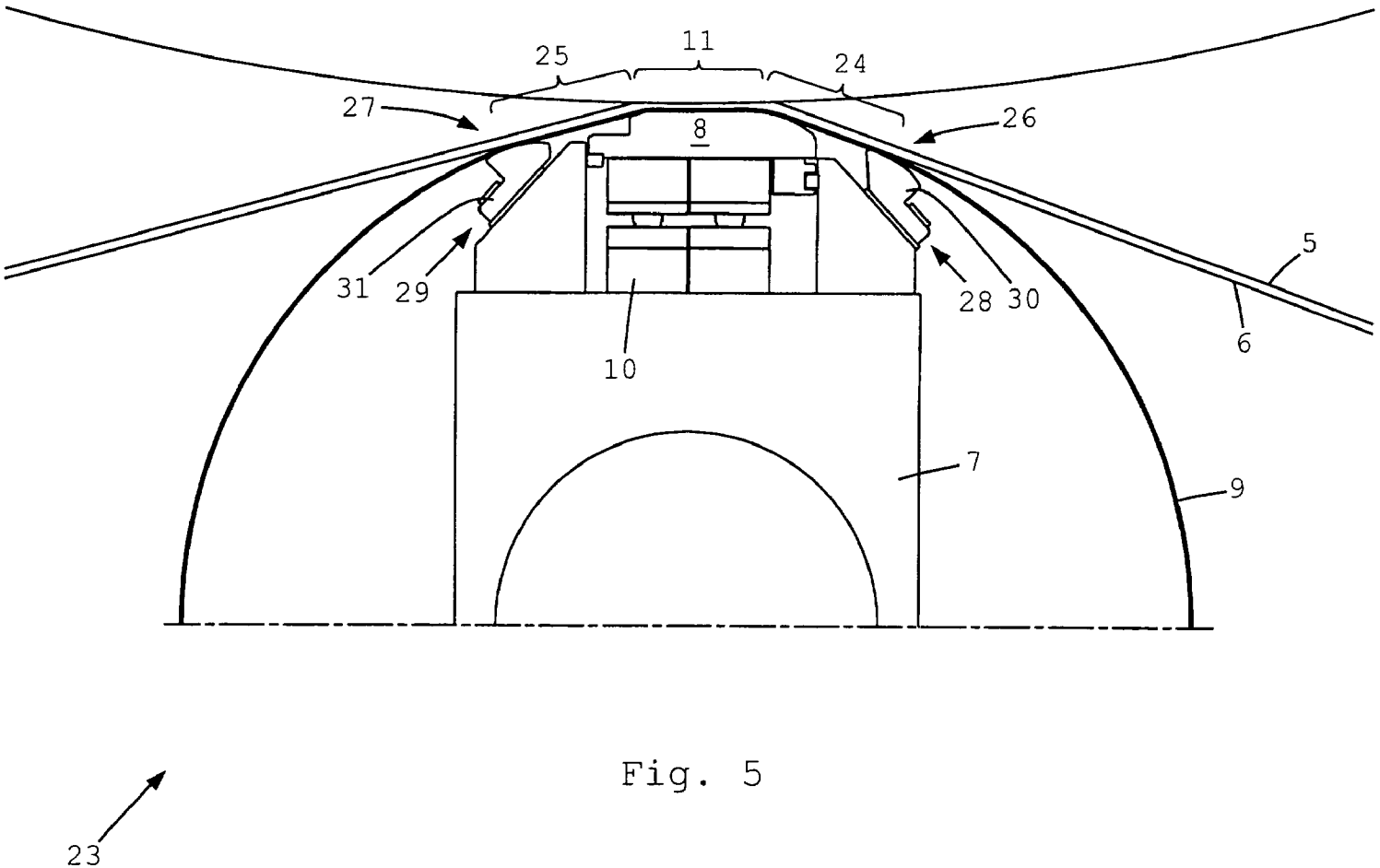
FIG. 5 shows a cross-section through a third embodiment of a press according to the invention.
Figure 6:
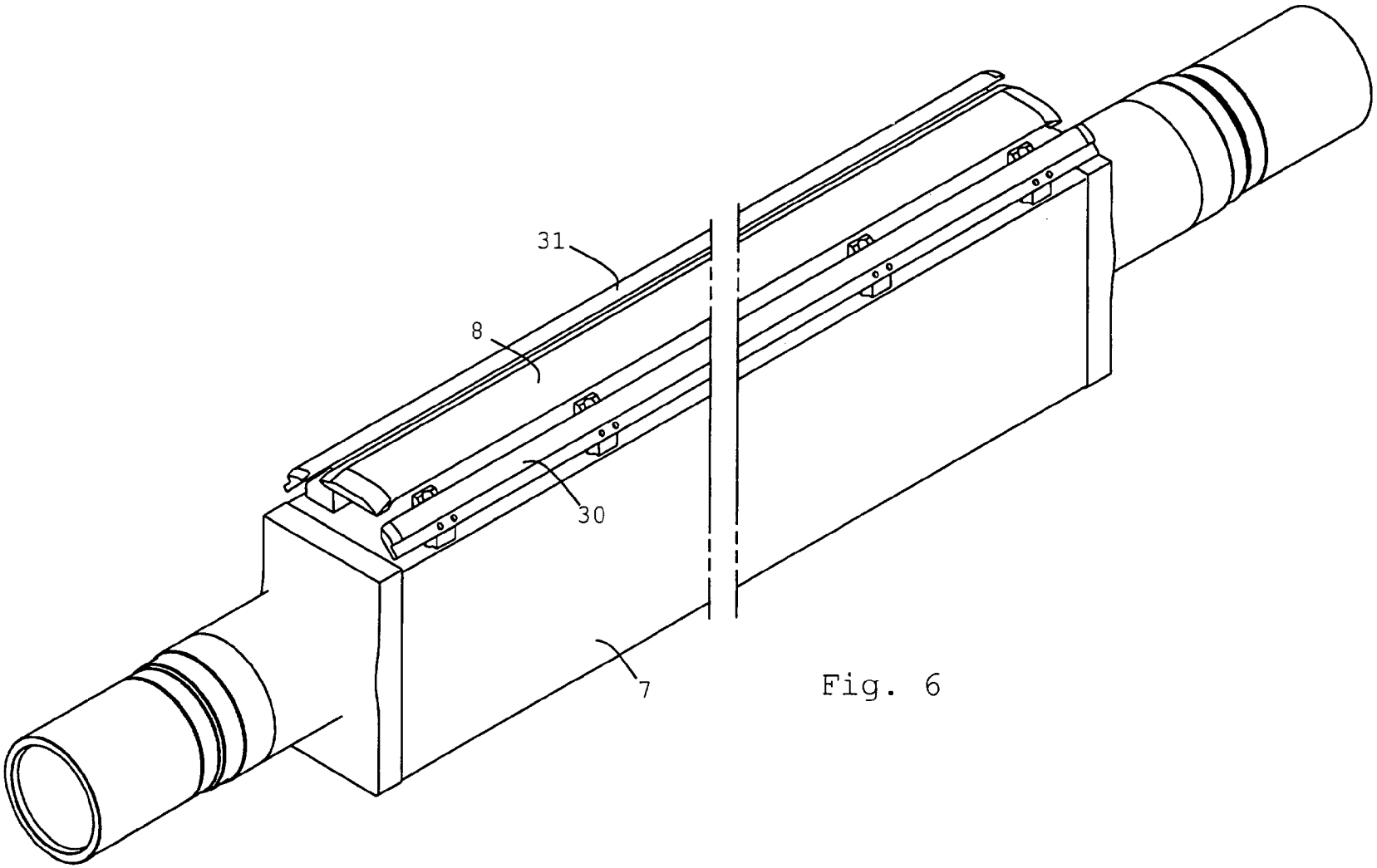
FIG. 6 shows a lateral view of a first press element of the press according to FIG. 5.
Figure 7:
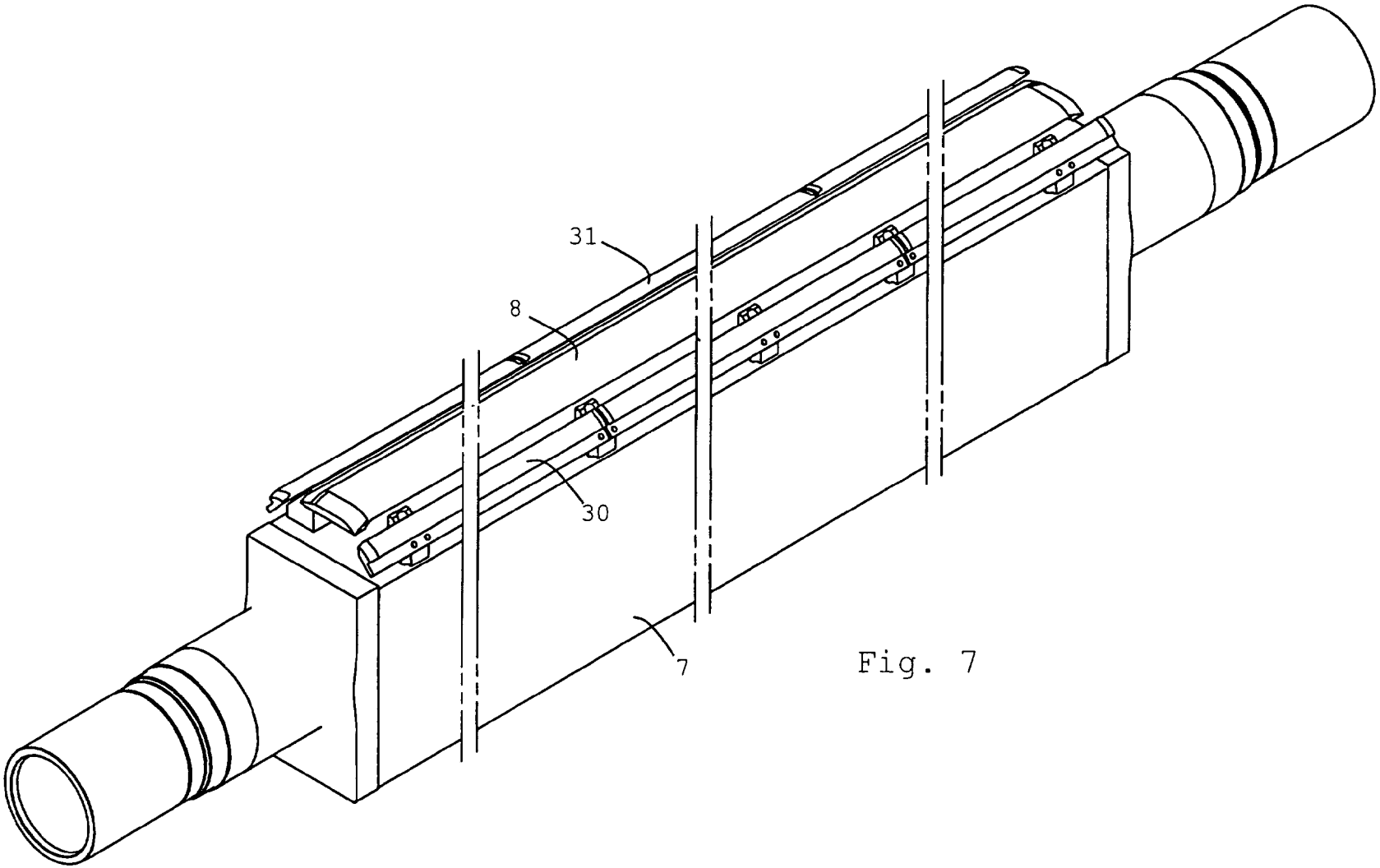
FIG. 7 shows a lateral view of an alternative embodiment of a support rail of the press according to FIG. 5.

FIGS. 5-7 show a third embodiment of a press 23 according to the invention. The press 23 is similar to the previously described presses 1 and 17, but in this case the fibre web 5, the press felt 6 and the belt 9 run in conjunction for a predetermined distance 24 upstream and a predetermined distance 25 downstream the press zone 11. Accordingly, the press felt 6 runs in conjunction with and surrounds the belt 9 between a first position 26, constituting the starting position of the distance 24, and a second position 27, constituting the terminal position of the distance 25. Accordingly, both the first position 26 and the second position 27 are located outside the press zone 11, and in this case the belt 9 loop exhibits a press felt-surrounded portion extending both up- and downstream the press zone 11. Two support elements 28, 29 are arranged inside the belt 9 loop for supporting the belt 9. The first support element 28 is arranged in the first position 26, and the second support element 29 is arranged in the second position 27. Accordingly, the support elements 28 and 29 are arranged in the starting and terminal position, respectively, of the press felt-surrounded portion. Like the above-described support elements 15 and 21, the respective support elements 28 and 29 should not be arranged further away from the starting and terminal position 26, 27, respectively, than 5° on the press felt-surrounded side of the belt 9, and 25° on the freely running side of the belt 9. Preferably, however, the support elements 28, 29 are arranged closer than that to the starting and terminal position 26, 27, respectively, for example no longer from the starting and terminal position 26, 27, respectively, than 3° on the press felt-surrounded side of the belt 9 and 15° on the freely running side of the belt 9, or no longer from the starting and terminal position 26, 27, respectively, than 0° on the press felt-surrounded side of the belt 9 and 5° on the freely running side of the belt 9. Most preferably, the respective support elements 28 and 29 are arranged in the vicinity of or in close vicinity of the starting and terminal position, respectively, wherein the first support element 28 is arranged so that the press felt 6 joins the belt 9 on top of or directly downstream the first support element 28, and the second support element 29 is arranged so that the press felt 6 deviates from the belt 9 on top of or directly upstream the second support element 29. Also in this case, the support elements 28 and 29 have the shape of support rails 30, 31, extending across the entire width of the first press element and which can be designed as a continuous part (see FIG. 6) or be divided into several segments, together extending across the entire width of the first press element (see FIG. 7).

Figure 8:
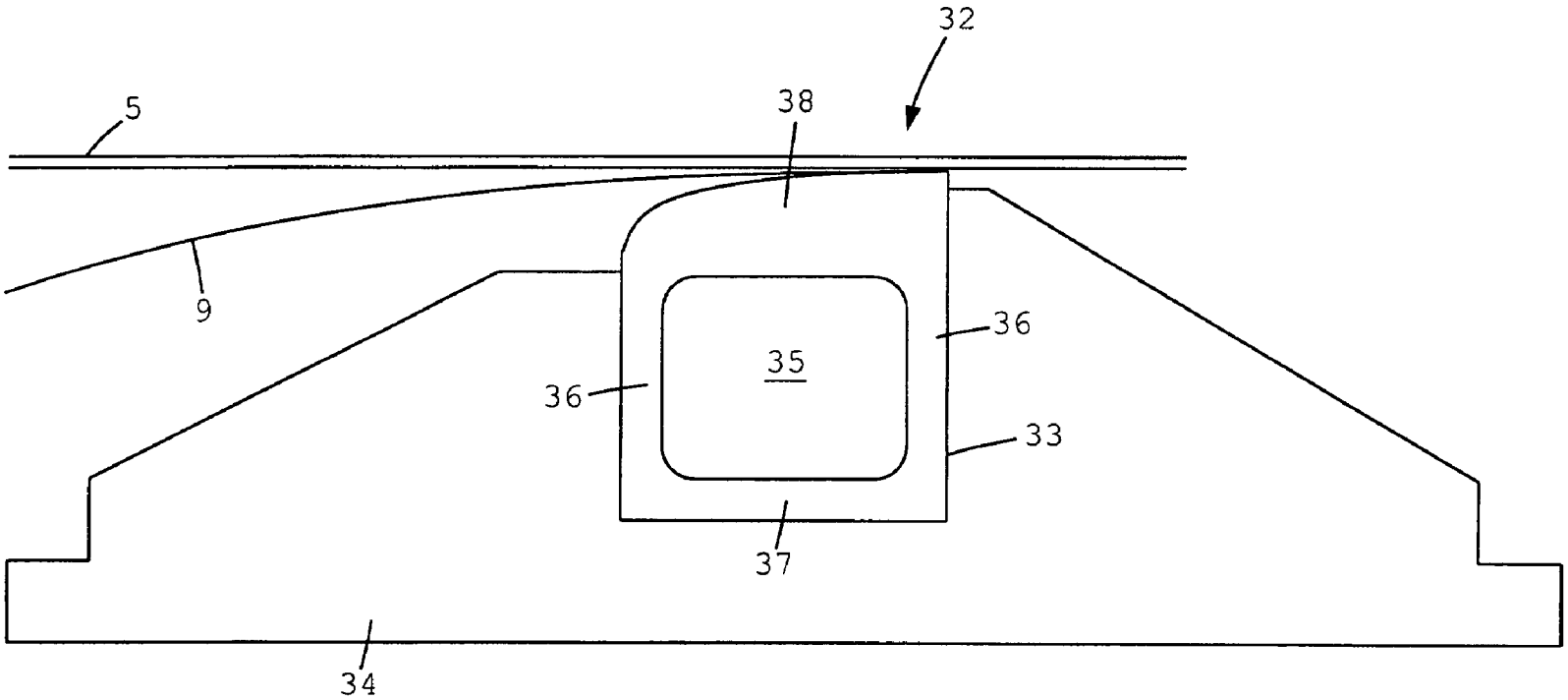
FIG. 8 shows an alternative embodiment of a support element according to the invention.

The support elements can be fixedly attached to the support 7, as is the case with the above-described support rails 16, 22, 30 and 31. FIG. 8 shows a cross-section of an alternative embodiment of a support element 32, where the support element 32 is movable or adjustable in a radial direction, i.e. in a direction substantially perpendicularly to the belt 9. In this case, the support element 32 is arranged in the position where the press felt 6 joins the belt 9, i.e. upstream the press zone, but a support element of this type can also be arranged in a position downstream the press zone. The support element 32 comprises a resiliently deformable support body 33. The support body 33 rests in a transversal, open and shape permanent duct in a support member 34 of the first press element, said duct having a U-shaped or rectangular cross-section. Accordingly, the support body 33 exhibits an external shape corresponding to the internal shape of the duct. Preferably, the support body 33 is made of polyurethane and the support member 34 is made of metal. The support body 33 includes an internal pressure chamber 35 for a pressure medium in a gas or liquid state, preferably hydraulic oil. The pressure chamber 35 is delimited by the two parallel long-side walls 36, a bottom wall 37, a top wall 38 and two parallel short-side walls (not shown) of the support body 33. The support element 32 also includes connecting members (not shown), through which said pressure medium can be supplied to or removed from the pressure chamber 35. Since the duct in which the support body 33 is resting is shape permanent, and the support body 33 is elastic, an increase of pressure inside the pressure chamber 35 results in the top wall 38 of the support body 33 bulging out. Consequently, the position of the support element 32 in a radial direction can be adjusted easily by means of supplying or removing said pressure medium. This adjustment can take place in operation, for example when changed pressure conditions occur in the press in which case it might be desirable to let the support element follow the radial displacement of the press body up and down or, for example, in the case of the second press element being a Yankee cylinder or other type of press cylinder which normally is stationary, i.e. which is not arranged for performing a translational movement, in which case the first press element with press body has to be capable of performing a relatively long translational movement in order to initiate a nip, wherein it is desirable to let the support elements follow the movements of the press body. As an alternative, the adjustment can be done in order to bring the support element 32 between an active position, where the support element 32 is in sliding contact with the belt 9, and a resting position, where the support element is not contacting the belt 9.

It will be appreciated that a support body of the type shown in FIG. 8, as an alternative, can include two or more pressure chambers with associated connecting members. By means of setting individual pressures in the different pressure chambers, different radial positions can be set in different positions along the resting surface of the support element. Furthermore, it will be appreciated that the press body can be designed resiliently deformable according to the same principle as the support body 33 shown in FIG. 8, wherein the press body, in principle, obtains a design identical to the support body but having other dimensions.

In the foregoing, the invention has been described with a number of embodiments as a starting point. It will be appreciated, however, that modifications, variants and alternative embodiments are possible within the scope of the invention. For instance, the support element can be displaceable in a radial direction by means of hydraulics or pneumatics instead of by means of the above-described elastic support body. Furthermore, the support element can be displaceable in a circumferential direction, i.e. along the belt loop, whereby it is possible to adapt the position of the support element to different press felt surrounds. Instead of constituting a sliding surface for the belt, the support element can be designed as a rotary roll which rotatably supports the belt.

The invention claimed is:

1. A press (1; 17; 23) for a fibre web (5) supported by a clothing (6), said press (1; 17; 23) comprising first and second press elements (2, 3), being arranged for interacting with each other in order to form an extended nip (4) in a press zone (11) for the clothing-supported fibre web (5), said first press element (2) comprising:

a support (7, 34);

a press body (8), being supported by the support (7, 34);

an endless, flexible belt (9), being arranged for sliding over and forming a closed loop around the press body (8); and a first support element (15; 21; 28; 29; 32), being arranged outside the press zone (11) and inside said loop for supporting the belt (9), said clothing (6) being arranged for running together with the belt (9) only along the length of a surrounded portion defined between a position (13, 20, 26) where the clothing (6) joins the belt (9) and a position (14, 19, 27) where the clothing separates from the belt (9), wherein at least a first position (13; 19; 26; 27) of said positions (13, 20, 26, 14, 19, 27) is located outside the press zone (11), characterized in that said first support element (15; 21; 28; 29) is arranged within a distance extending between 5° downstream and 25° upstream of the first position (13, 26) measured along the belt (9) loop when said first position (13; 26) is located upstream of the press zone (11), or within a distance extending between 5° upstream and 25° downstream of the first position (19, 27) measured along the belt (9) loop when said first position (19, 27) is located downstream of the press zone (11).

2. A press (1) according to claim 1, characterized in that said first position (13) is located upstream of the press zone (11).

3. A press (1) according to claim 2, characterized in that the first support element (15) is located such that the clothing (6) joins the belt (9) on top of the first support element (15).

4. A press (17) according to claim 1, characterized in that said first position (19) is located downstream of the press zone (11).

5. A press (17) according to claim 4, characterized in that the first support element (21) is located such that the clothing (6) separates from the belt (9) directly on top of the first support element (21).

6. A press (23) according to claim 1, characterized in that the second position (26, 27) of said positions (13, 20, 26, 14, 19, 27) is also located outside said press zone (11), and that a second support element (28, 29) is arranged outside the press zone (11) and inside said loop for supporting the belt (9) within a distance extending between 5° downstream and 25° upstream of the second position (26) measured along the belt (9) loop when said second position (26) is located upstream of the press zone (11), or within a distance extending between 5° upstream and 25° downstream of the second position (27) measured along the belt (9) loop when said second position (27) is located downstream of the press zone (11).

7. A press (23) according to claim 6, characterized in that said first position (26) is located upstream of the press zone (11) and that said second position (27) is located downstream of the press zone (11).

8. A press (23) according to claim 7, characterized in that the first support element (28) is located such that the clothing (6) joins the belt (9) on top of the first support element (28), and that the second support element (29) is located such that the clothing (6) separates from the belt (9) on top of the second support element (29).

9. A press (1; 17; 23) according to claim 1, characterized in that at least one of said support elements (15; 21; 28, 29, 32) is attached to the support (7, 34).

10. A press (1; 17; 23) according to claim 9, characterized in that said at least one support element (15; 21; 28, 29) comprises a support rail (16; 22; 30, 31).

11. A press according to claim 1, characterized in that at least one of said support elements (32) is movable in a direction perpendicular to the belt (9).

12. A press according to claim 11, characterized in that said at least one support element (32) comprises an elastic support body (33), being extensible in a direction perpendicular to the belt (9).

13. A press according to claim 12, characterized in that the support body (33) comprises an internal pressure chamber (35), in which pressure chamber (35) a pressure medium is arranged for being supplied or removed in order to achieve said extensibility.

14. A press element (2), comprising:

a support (7, 34);

a press body (8), being supported by the support (7, 34);

an endless, flexible belt (9), being arranged for sliding over and forming a closed loop around the press body (8); and a first support element (15; 21; 28; 29; 32), being arranged outside the press zone (11) and inside said loop for supporting the belt (9), said press element (2) being intended for interacting with a second press element (3) in order to form an extended nip (4) in a press zone (11) for a fibre web (5) supported by a clothing (6), said clothing (6) being intended for running together with the belt (9) only along the length of a surrounded portion defined between a position (13, 19, 26) where the clothing (6) joins the belt (9) and a position (14, 20, 27) where the clothing (6) separates from the belt (9), wherein at least a first position (13; 19; 26; 27) of said positions (13, 20, 26, 14, 19, 27) is located outside the press zone (11), characterized in that said first support element (15; 21; 28; 29) is arranged within a distance extending between 5° downstream and 25° upstream of the first position (13, 26) measured along the belt (9) loop when said first position (13; 26) is located upstream of the press zone (11), or within a distance extending between 5° upstream and 25° downstream of the first position (19, 27) measured along the belt 9) loop when said first position (19, 27) is located downstream of the press zone (11).

15. A press element (2) according to claim 14, where a second position (26; 27) of said positions (13, 20, 26, 14, 19, 27) is also located outside said press zone (11), characterized in that a second support element (28; 29) is arranged outside the press zone (11) and inside the belt (9) loop for supporting the belt (9) within a distance extending between 5° downstream and 25° upstream of the second position (26) measured along the belt (9) loop when said second position (26) is located upstream of the press zone (11), or within a distance extending between 5° upstream and 25° downstream of the second position (27) measured along the belt (9) loop when said second position (27) is located downstream of the press zone (11).

* * * * *